US007267257B2

(12) United States Patent
Erhardt et al.

(10) Patent No.: US 7,267,257 B2
(45) Date of Patent: Sep. 11, 2007

(54) COMBUSTION-ENGINED SETTING TOOL

(75) Inventors: Rolf Erhardt, Buchs (CH); Stefan Boenig, Achberg-Esseratsweiler (DE); Ulrich Rosenbaum, Wangs (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 11/349,509

(22) Filed: Feb. 6, 2006

(65) Prior Publication Data

US 2006/0175373 A1 Aug. 10, 2006

(30) Foreign Application Priority Data

Feb. 10, 2005 (DE) ..... 10 2005 006 168

(51) Int. Cl.
*B27F 7/09* (2006.01)
*B25C 1/08* (2006.01)

(52) U.S. Cl. ..... 227/10; 227/8; 227/130; 227/134

(58) Field of Classification Search ..... 227/9–11, 227/130, 134
See application file for complete search history.

(56) References Cited

U.S. PATENT DOCUMENTS 3,042,008 A * 7/1962 Liesse ..... 123/46 SC
3,438,406 A * 4/1969 Rozmus ..... 140/93.2
3,506,178 A * 4/1970 Brunelle ..... 227/10
3,924,789 A * 12/1975 Avery et al. ..... 227/131
4,093,110 A * 6/1978 Johnson ..... 227/9
4,200,213 A * 4/1980 Liesse ..... 227/10
4,483,473 A * 11/1984 Wagdy ..... 227/8
4,544,090 A * 10/1985 Warman et al. ..... 227/131
4,662,557 A * 5/1987 Lee ..... 227/147
4,717,060 A * 1/1988 Cotta ..... 227/10
5,114,064 A * 5/1992 Jochum et al. ..... 227/9
5,205,328 A * 4/1993 Johnson et al. ..... 140/93.2
6,145,724 A * 11/2000 Shkolnikov et al. ..... 227/8
6,260,519 B1 * 7/2001 Phillips ..... 123/46 R
6,786,378 B2 * 9/2004 Wagdy et al. ..... 227/9
7,086,574 B2 * 8/2006 Dittrich et al. ..... 227/10
7,128,252 B2 * 10/2006 Boenig et al. ..... 227/10

* cited by examiner

*Primary Examiner*—Rinaldi I. Rada
*Assistant Examiner*—Lindsay Low
(74) *Attorney, Agent, or Firm*—Abelman, Frayne & Schwab

(57) ABSTRACT

A combustion-engined setting tool for driving fastening elements in a constructional component includes a guide cylinder (12), adjoining the combustion chamber (14) and in which a setting piston (11) is displaceable, a press-on element (30), and a transmission device for connecting the press-on element (30) with the combustion chamber rear wall (16) for axially displacing same in response to a press-on stroke of the press-on element, with the transmission device being formed as a cable drive (20) having a transmission member (21) and at least one deflection roller (24) for the transmission member (21).

11 Claims, 2 Drawing Sheets

COMBUSTION-ENGINED SETTING TOOL

BACKGROUND OF THE INVENTION

1. Field of the Invention

The present invention relates to a combustion-engined setting tool for driving fastening elements in a constructional component and including a combustion chamber for an oxidant-fuel gas mixture and having at least one axially displaceable wall, a guide cylinder adjoining the combustion chamber, a setting piston displaceable in the guide cylinder, a press-on element, and a transmission device for connecting the press-on element with the at least one combustion chamber wall for axially displacing same in response to a press-on stroke of the press-on element.

2. Description of the Prior Art

Setting tools of the type described above are operated with gaseous or liquid fuels that should be evaporated before combustion. The setting energy for driving in a fastening element by a setting piston. The oxidant is, e.g., oxygen of the environmental air. Before each setting process, therefore, fresh air should be brought into the combustion chamber and after each setting process, the flue gas, which is produced by combustion, should be removed from the combustion chamber.

In order to be able to carry out a setting process, the setting tool should be pressed against a constructional component to prevent actuation of the setting tool without a contact with the constructional component. The press-on stroke should be as small as possible for ergonomical reasons.

German Publication DE 40 32 203 A1 discloses a combustion-engined setting tool including a combustion chamber for combusting an air-fuel mixture and a setting piston displaceable in a guide cylinder and driven by a working pressure produced by the combustion of the air-fuel mixture. The combustion chamber is located in a first section of the setting tool housing, with the second housing section being displaceable relative to the first housing section. Further, the guide cylinder is likewise displaceable relative to the combustion chamber, being displaceable by an intermediate rack-and-pinion gear upon displacement of the second housing section relative to the first housing section. The relative movement of the second housing section relative to the first housing section upon pressing of the setting tool against the constructional component, provides for displacement of the guide cylinder away from the combustion chamber and, thus, for expansion of the combustion chamber volume.

The combustion chamber is divided in sub-chambers. These sub-chambers are separated by at least one displaceable intermediate or separation wall displaceable together with the guide cylinder. For evacuating the flue gases from the combustion space, the guide cylinder is displaced, together with an arranged thereon, combustion chamber wall, into the combustion chamber, reducing the volume of both sub-chambers to a minimum. The intermediate wall is displaced together with the guide cylinder. The flue gases are removed from the setting tool. When the sub-chambers are displaced away from each other, when the setting tool is again pressed against a constructional component, the sub-chambers are filled with fresh air.

The drawback of the known setting tool is a complicated and expensive to produce, mechanics that provides for expansion of the combustion volume in the combustion chamber.

In a setting tool Hilti GX 100 of the assignee herein, a setting piston is displaced in a piston guide that is adjoined, in the drive-in direction, by a bolt guide. At its end opposite the bolt guide, the piston guide is adjoined by a combustion chamber having a rear wall coaxially displaceable relative to the combustion chamber. When the setting tool is pressed against a constructional component, the rear wall of the combustion chamber is displaced away from the piston cylinder, and the return springs are compressed, whereby the combustion chamber is expanded.

Simultaneously with the expansion of the combustion chamber, it is filled with fresh air. The press-on path is equal to the path of displacement of the combustion chamber rear wall away from the piston cylinder that is equal to the axial length of the combustion chamber. After completion of the setting process and lifting of the setting tool off the constructional component, the combustion chamber rear wall moves back into its initial position under the biasing forces of the return springs, whereby the flue gases are expelled upon collapse of the combustion chamber. The advantage of the above-described setting tool consists in that no accumulator or battery is needed as evacuation of the combustion chamber is effected mechanically.

However, the above-described setting tool has a relatively long press-on path and a relatively large diameter of the combustion chamber.

European Patent EP 0 711 634 B1 discloses a combustion-engined setting tool having a combustion chamber for combusting a fuel gas-air mixture, with ventilator means provided in the combustion chamber for creating turbulence. The ventilator means is driven by an electric motor that is supplied with an electrical energy by a battery.

The use of the ventilator means for rinsing the combustion chamber permits to keep the press-on path rather short.

The drawback of this setting tool consists of its large weight resulting from the need of a battery or accumulator and of the need to replace them when their energy dies out.

Accordingly, an object of the present invention is to provide a setting tool of the type described above in which the drawbacks of the known setting tools are eliminated.

SUMMARY OF THE INVENTION

This and other objects of the present invention, which will become apparent hereinafter, are achieved by forming the transmission device as a cable drive having a transmission member such as, e.g., cable, chain, or band, and at least one deflection roller for the transmission member, and by forming the at least one axially displaceable wall of the combustion chamber as a rear wall.

The displacement of the combustion chamber rear wall by the cable drive that has a transmission member and a deflection roller and converts the press-on movement into the axial movement of the rear wall, permits to obtain a short ergonomical press-on stroke at a reduced number of parts, small assembly expenses, and a small diameter of the combustion chamber. As a result, a transmission ratio of 1:2 or higher can be easily achieved. The advantage of the cable drive further consists in that it is less expensive and has a smaller weight in comparison with toothed gear or rack-and-pinion gear.

According to an advantageous further development of the present invention, the transmission member is secured with a first end to the guide cylinder and with its second end to the combustion chamber rear wall, with the at least one deflection roller being secured on a component of the press-on element. This insures a transmission ratio of 1:2, i.e., the displacement path of the combustion chamber rear wall is twice as large as the displacement path of the press-on element. Thus, a very short press-on path can be realized.

Advantageously, the combustion chamber sleeve, which forms the combustion chamber, is connected with the press-on element for joint displacement therewith, so that the combustion chamber sleeve is displaced automatically with the press-on element when the setting tool is pressed against a constructional component.

Advantageously, the at least one deflection roller is supported on a support member arranged at an end of the combustion chamber sleeve remote from the press-on element. With the deflection roller projecting at the end of the combustion chamber sleeve remote from the press-on element, the transmission member, which is deflected by the deflection roller, can be guided over the combustion chamber rear wall from outside, without passing through the combustion chamber.

Advantageously, spring means is provided between the guide cylinder and the press-on element for biasing the press-on element away from the guide cylinder. This insures an automatic return of the press-on element in its initial position because the spring means automatically displaces the press-on element away from the guide cylinder when the setting tool is lifted off the constructional component. Simultaneously, with the combustion chamber sleeve being fixedly connected with the press-on element, the sleeve is also displaced in its initial position.

Advantageously, there is provided spring means for biasing the combustion chamber rear wall in the direction of the guide cylinder. This means insures return of the combustion chamber rear wall into its initial position on the guide cylinder when the setting tool is lifted of the constructional component. Thereby, the combustion chamber collapses. Also, thereby, the flue gases can be expelled from the combustion chamber.

Simultaneously, providing respective spring means between the guide cylinder and the combustion chamber rear wall, on one hand, and between the press-on element and the guide cylinder, on the other hand, provides for permanent tensioning of the transmission member so that it cannot by displaced out of its guide path or out of its deflection roller or rollers.

Advantageously, the transmission member is formed as a steel cable which has a good durability. This insures a long service life and a good transmission of tension forces.

Advantageously, the press-on element is formed as a bolt guide or its part. This permits to avoid use of additional parts for forming the press-on element, whereby a compact construction can be obtained.

Advantageously, there is provided guide means for displaceably guiding the press-on element coaxially toward the guide cylinder. This insures a reliable functioning of the cable drive even after an extended operating life of the setting tool. This is because no torsion takes place between the press-on element and the guide cylinder that might have damaged the transmission member.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
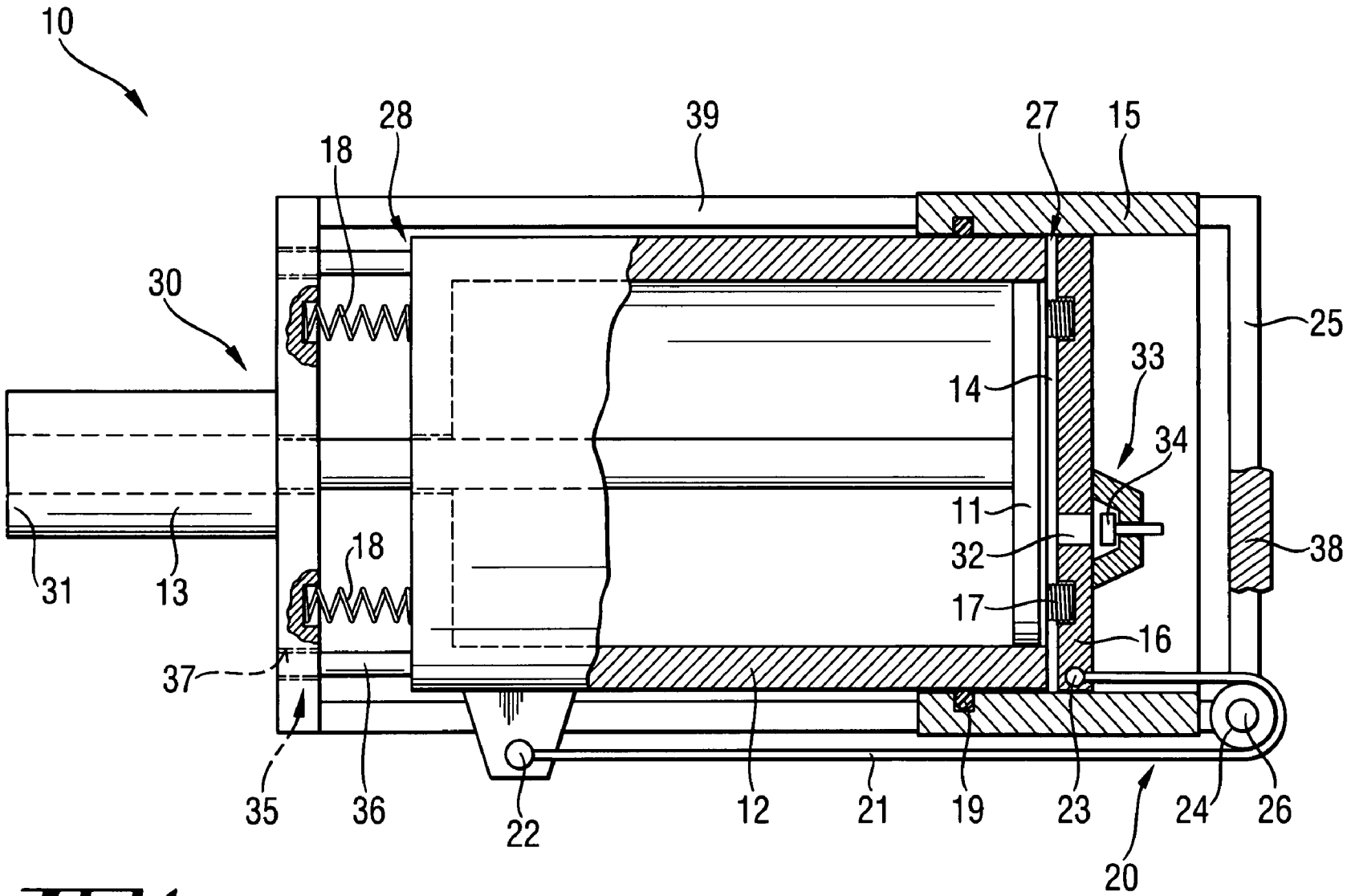
FIG. 1 a longitudinal, partially cross-sectional view of a setting tool according to the present invention in an initial position thereof.
Figure 2:
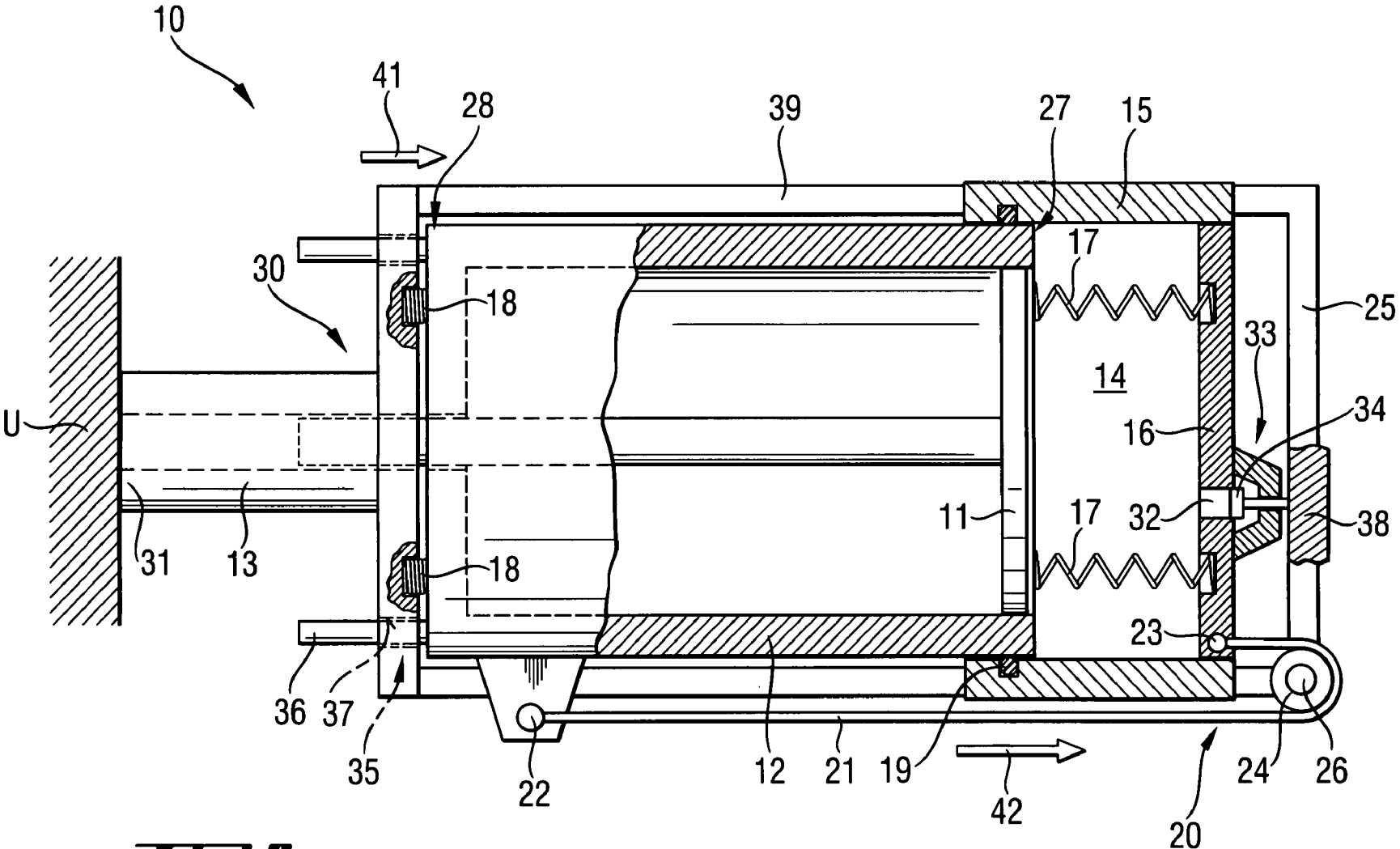
FIG. 2 a longitudinal, partially cross-sectional view of the setting tool shown in FIG. 1 in a position in which the setting tool is pressed against a constructional component.

FIGS. 1-2 show a first embodiment of a setting tool according to the present invention. The setting tool 10 is operated on a fuel gas which is stored in a fuel reservoir (not shown) in the form of a liquefied gas. Instead of a fuel gas, an evaporable liquid fuel such as, e.g., alcohol, gasoline can be used. The setting tool 10 has a setting mechanism with which a fastening element, not shown, is driven in a constructional component U when the setting tool 10 is pressed against the construction component and is actuated. The setting mechanism includes, among others, a combustion chamber 14 for an oxidant-fuel gas mixture, a guide cylinder 12 having a first axial end 27 and a second axial end 28, a setting piston 11 axially displaceable in the guide cylinder 12, and a bolt guide 13 adjoining the second axial end 28 of the guide cylinder 12 remote from the combustion chamber 14. The bolt guide 13 serves for guiding a fastening element, e.g., a bolt or a nail, functioning simultaneously as a press-on element 30 that is provided with a press-on nose 31. The press-on element 30 is axially displaceable relative to the guide cylinder 12. Guide means 35 provides for displacement of the press-on element 30 over the guide cylinder 12. The guide means 35 includes guide pins 36 arranged at the second axial end 28 of the guide cylinder 12, projecting therefrom, and guide bores 37 formed in the press-on element 30 in which the guide pins 36 are displaceable.

The combustion chamber 14 is provided in a cylindrical combustion chamber sleeve 15 that is displaceably arranged on the first axial end 27 of the guide cylinder 12 and is sealed with respect to the guide cylinder 12 by at least one sealing element 19, e.g., a sealing ring. In the combustion chamber sleeve 15, there is arranged a displaceable, combustion chamber rear wall 16. The combustion chamber rear wall 16 is biased in the direction of the first end 27 of the guide cylinder 12 by a spring 17, in particular tension spring. The spring 17 retains the rear wall 16 in an initial position of the setting tool 10 shown in FIG. 1, in which the combustion chamber 14 is in its collapsed condition. An opening 32 is formed in a rear wall 16 of the combustion chamber sleeve 15. Through the opening 32, an oxidant, such as, e.g., environmental air, and fuel can be fed into the combustion chamber 14. At the opening 32, there is provided a valve 33 with a valve body 34 which closes or opens the opening 32. The valve body 34 is biased in the direction of its open position shown in FIG. 1 by a spring member (not shown). After a setting process, flue gases can be evacuated outwardly through the opening 32.

It should be understood that several openings can be provided. Thus, fuel can be delivered into the combustion chamber 14, e.g., through a separate opening.

A rod-shaped connection element 39 fixedly connects the combustion chamber sleeve 15 with the press-on element 30. During the press-on process, the combustion chamber sleeve 15 is displaced, together with the press-on element 30 relative to the guide cylinder 12. The press-on element 30, the connection element 39, and the combustion chamber sleeve 15 form parts of a press-on device for effecting a press-on stroke.

On the assembly of arranged one after another press-on element 30, guide cylinder 12, the combustion chamber sleeve 15, and the combustion chamber rear wall 16, there is provided a cable drive designated generally with a reference numeral 20 and formed as a cable and pulley drive. The cable drive 20 converts the press-on movement of the press-on element 30 in direction of arrow 41 (FIG. 2) when the press-on nose 31 is pressed against the constructional component U, in movement of the combustion chamber rear wall 16 relative to the guide cylinder 12 in the direction of arrow 42 with a ratio 1:2, i.e., the displacement path of the combustion chamber rear wall 16 relative to the guide cylinder 12 during a press-on process is three times as large as the displacement path of the press-on element 30 together with the combustion chamber sleeve 15 relative to the guide cylinder 12, with all of the movements being effected in the longitudinal direction of the guide cylinder 12.

The cable drive 20 includes a transmission member 21 which is formed as a steel cable and is secured with its first end 22 to the guide cylinder 12 or a projection thereof, and with its second end 23 to the combustion chamber rear wall 16. The transmission member 21 is guided further over a deflection roller 24 being deflected once over this roller. The deflection roller 24 is rotationally mounted on a support member 25, directly above the combustion chamber sleeve 15, and is supported on a journal 26. The support member 25 is fixedly connected with the combustion chamber sleeve 15 and, thereby, with the press-on element 30. Therefore, during the press-on step in the direction of arrow 41, the deflection roller 24 is displaced together with the press-on element 30 and the combustion chamber sleeve 15.

Between the press-on element 30 and the second axial end 28 of the guide cylinder 12, there is provided one or several spring members 18 formed as compression spring elements. The spring members 18 press the guide cylinder 12 and the press-on element 30 away from each other in the initial position of the setting tool 10 shown in FIG. 1. When the setting tool 10 is pressed against the constructional component U, as shown in FIG. 2, the distance between the guide cylinder 12 and the press-on element 30 is shortened, which results in compression of the spring members 18. As a result of the reduction of the distance between the press-on element 30 and the guide cylinder 12, the spring members 17, which are provided between the combustion chamber sleeve 15 and the rear wall 16 are displaced in the direction of arrow 42, whereby the combustion chamber 14 expands. The combustion chamber rear wall 16 and the combustion chamber sleeve 15 are locked in the expanded position, e.g., by suitable pawls. The valve body 34 runs against a stop 38 during the displacement of the combustion chamber rear wall 16, so that the valve 33 closes the opening 32 in the completely expanded condition of the combustion chamber 14. In this condition of the combustion chamber 14, it is filled with a fuel-air mixture that can be ignited by an ignition element, e.g., an ignition plug. The setting tool 10 is ready for carrying out a setting process which is actuated by an actuation switch.

When the setting tool 10 is lifted off the constructional component U in the direction of arrow 41, the spring members 17 and 18 are released, respectively. Thereby the combustion chamber sleeve 15, together with the press-on element 30, and the rear wall 16 move to their initial position shown in FIG. 1, whereby the combustion chamber 14 collapses. The flue gases, which remain in the combustion chamber 14, are released through the again open opening 32. Simultaneously, the transmission member 21 is displaced over the deflection roller 24, together with the deflection roller 24, to the initial position shown in FIG. 1.

The setting tool 10 can also be so formed that the cable drive 20 would have two transmission members 21 guided over respective deflection rollers. These pulleys can be symmetrically arranged on the setting tool 10 to prevent tilting during the expansion process of the combustion chamber 14.

It is also possible to so form the setting tool that the cable drive would have more than one deflection roller in order to increase the transmission ratio. The transmission member can be attached with one of its ends to the press-on element and with another of its ends to the combustion chamber rear wall. The transmission member can be guided over two deflection rollers one of which is supported on the guide cylinder and the other is supported on the press-on element. In this case, a transmission ratio of 1:3 is achieved.

In an ideal case, the deflected sections of the transmission member or each of two transmission members are guided parallel to each other so that, respectively, a most possible transmission ratio is achieved.

Though the present invention was shown and described with reference to the preferred embodiment, such is merely illustrative of the present invention and is not to be construed as a limitation thereof and various modifications of the present invention will be apparent to those skilled in the art. It is, therefore, not intended that the present invention be limited to the disclosed embodiments or details thereof, and the present invention includes all variations and/or alternative embodiment within the spirit and scope of the present invention as defined by the appended claims.

What is claimed is:

1. A combustion-engined setting tool for driving fastening elements in a constructional component, comprising:

a combustion chamber (14) for an oxidant-fuel gas mixture and having an axially displaceable rear wall (16);

a guide cylinder (12) adjoining the combustion chamber (14);

a setting piston (11) displaceable in the guide cylinder (12);

a press-on element (30); and a transmission device mounted to the press-on element and the combustion chamber rear wall such that the rear wall is displaced axially in response to a press-on stroke of the press-on element, the transmission device being formed as a cable drive (20) having a transmission member (21) and at least one deflection roller (24) for the transmission member (21).

2. A combustion-engined setting tool according to claim 1, wherein the transmission member (21) is secured with a first end (22) thereof to the guide cylinder (12) and with a second end (23) thereof to the combustion chamber rear wall (16), and wherein the at least one deflection roller (24) is supported on a component of the press-on element (30).

3. A combustion-engined setting tool according to claim 1, comprising a combustion chamber sleeve (15) forming the combustion chamber (14) and connected with the press-on element (30) for joint displacement therewith.

4. A combustion-engined setting tool according to claim 3, wherein the at least one deflection roller (24) is supported on a support member (25) arranged at an end of the combustion chamber sleeve (15) remote from the press-on element.

5. A combustion-engined setting tool according to claim 1, further comprising spring means (18) provided between the guide cylinder (12) and the press-on element (30) for biasing the press-on element (30) away from the guide cylinder (12).

6. A combustion-engined setting tool according to claim 1, further comprising spring means (17) for biasing the combustion chamber rear wall (16) in a direction of the guide cylinder (12).

7. A combustion-engined setting tool according to claim 1, wherein the transmission member (21) is formed as a cable.

8. A combustion-engined setting tool according to claim 1, wherein the transmission member (21) is formed as a steel cable.

9. A combustion-engined setting tool according to claim 1, wherein the press-on element (30) is formed as a bolt guide (13).

10. A combustion-engined setting tool according to claim 1, further comprising guide means (35) for guiding the press-on element (30) coaxially to the guide cylinder (12).

11. A combustion-engined setting tool according to claim 1, wherein the press-on element (30) has a press-on nose (31) for pressing against a constructional component (u).

* * * * *